US008840383B2

(12) United States Patent
Zhang

(10) Patent No.: US 8,840,383 B2
(45) Date of Patent: Sep. 23, 2014

(54) METHOD AND APPARATUS FOR IMPROVED, HIGH-PRESSURE, FLUID PUMP

(75) Inventor: Da Quan Zhang, Taicang (CN)

(73) Assignee: Power Plus Products Ltd., Hong Kong (HK)

( * ) Notice: Subject to any disclaimer, the term of this patent is extended or adjusted under 35 U.S.C. 154(b) by 91 days.

(21) Appl. No.: 12/698,049

(22) Filed: Feb. 1, 2010

(65) Prior Publication Data

US 2011/0189041 A1 Aug. 4, 2011

(51) Int. Cl.
*F04B 39/10* (2006.01)

(52) U.S. Cl.
CPC ..... *F04B 39/10* (2013.01)
USPC ..... 417/568

(58) Field of Classification Search
USPC ..... 417/62, 269, 271, 270, 559–571; 137/540, 543.19, 512, 535, 540.11, 137/541–543, 543.13, 543.15, 543.17, 137/543.21, 543.23
See application file for complete search history.

(56) References Cited

U.S. PATENT DOCUMENTS

| | | | | |
|---|---|---|---|---|
| 1,356,684 | A | 10/1920 | Aikman | |
| 1,507,448 | A * | 9/1924 | Aldrich | 137/512 |
| 2,998,827 | A * | 9/1961 | Cook et al. | 137/543.13 |
| 3,151,569 | A * | 10/1964 | Muller | 417/270 |
| 3,335,575 | A | 8/1967 | Hedrick | |
| 4,351,227 | A * | 9/1982 | Copp et al. | 92/71 |
| 4,716,924 | A * | 1/1988 | Pacht | 137/327 |
| 5,145,340 | A | 9/1992 | Allard | |
| 5,632,607 | A * | 5/1997 | Popescu et al. | 417/415 |
| 6,705,846 | B2 * | 3/2004 | Greiff et al. | 417/560 |
| 7,513,759 | B1 * | 4/2009 | Blume | 417/568 |
| 2006/0127245 | A1 | 6/2006 | Ohmi et al. | |
| 2007/0140870 | A1 | 6/2007 | Fukanuma et al. | |

OTHER PUBLICATIONS

Officer Action dated Jan. 4, 2013 in U.S. Appl. No. 12/774,251.
Office Action dated Oct. 26, 2012 in Taiwanese Patent Application No. 099103933.
U.S. Appl. No. 12/774,251, filed May 5, 2010.
Office Action dated Apr. 3, 2012 in U.S. Appl. No. 12/774,251.
Office Action dated Jan. 4, 2013 in U.S. Appl. No. 12/774,251.
Office Action dated Jun. 27, 2013 in U.S. Appl. No. 12/774,251.

* cited by examiner

*Primary Examiner* — Peter J Bertheaud
*Assistant Examiner* — Dnyanesh Kasture
(74) *Attorney, Agent, or Firm* — Byrne Poh LLP

(57) ABSTRACT

An apparatus for constructing a high pressure fluid pump having a piston housing, a pump head connected to and supported by the piston housing, and a pump pedestal for supporting the pump head and the piston housing is provided. The pump head receives water at low pressure and, in combination with the piston housing, produces fluid through a flow channel at high pressure. The combination of piston housing and pump head contains a valve which, in response to a suction on one side of the valve, allows water at low pressure to pass through the valve into a receiving chamber, and, in response to a high pressure fluid in the receiving chamber, enables fluid at a high pressure to pass through the valve and eventually to an output port while closing off the input path. The pump can have an aluminum pump head structured to withstand high pressure fluid impact.

5 Claims, 6 Drawing Sheets

METHOD AND APPARATUS FOR IMPROVED, HIGH-PRESSURE, FLUID PUMP

The method and apparatus relate generally to the creation of high pressure fluid streams. The method and apparatus efficiently, using a small footprint, generate such fluid streams, and more particularly, the method and apparatus generate high-pressure water streams from a low pressure water input from ordinary residential or commercial sources, using a rotary motor mechanical power input.

BACKGROUND OF THE INVENTION

High pressure water washers are well known. They are used for various cleaning purposes as well as to remove various materials from a harder surface. High pressure pumps, used as a component of the high pressure washers, have also been developed over the years with the goal of providing reliable high pressure streams of water. Nevertheless, these pumps, while following typically similar paths, have not achieved the combination of reliability, performance, cost, and footprint, which is most desirable. Accordingly, pumps with smaller footprints, higher reliability, lower operating costs, and lower manufacturing costs are both desirable and commercially preferable. Such pumps can result, therefore, in higher pump life at a lower cost and a smaller footprint. This advantage enables more individuals to purchase such pumps for personal use as well as enabling the construction of commercial pumps with higher reliability and lower cost.

SUMMARY OF THE INVENTION

In one aspect, the invention relates to a high pressure fluid pump having a piston housing, a pump head connected to and supported by the piston housing, a pump pedestal for supporting the pump head and the piston housing; the pump head receiving fluid at a low pressure, and, in combination with the piston housing, producing fluid through a flow channel at a high pressure. The combination of piston housing and pump head contains a 'go-thru" valve which in response to a suction on one side of the valve allows input fluid at a low pressure to pass through the valve and into a receiving chamber, and in response to a high pressure in the receiving chamber enables fluid at a high pressure in the chamber to pass through the valve to an outlet port while blocking the low pressure fluid path through the valve.

In another aspect, the high pressure fluid pump further has a pump head made from aluminum, wherein the outer surfaces of the pump have concave relief elements for strengthening the pump head against high pressures from within the pump head. Further the high pressure fluid pump can have a receiving chamber having a diameter greater than 5 mm.

In a further aspect of an embodiment of the invention, a high pressure fluid pump relates to a piston housing, a pump head connected to and supported by the piston housing, a pump pedestal for supporting the pump head and the piston housing, wherein the pump head receives fluid at a low pressure, and, in combination with the piston housing, producing fluid through a flow channel at a high pressure. The combination of pump head, piston housing, and pump pedestal together enclose and include a wobble plate, a plurality of pistons, and a fluid receiving/exiting chamber, wherein the wobble plate is rotated by an external rotary source. The wobble plate is in contact with a drive to reciprocate the pistons in timed sequence to each other, and the pistons act to draw fluid into the receiving chamber on a first stroke away from the chamber and compress the fluid at high pressure during a second stroke toward the chamber. The combination of piston housing and pump head contains a 'go-thru" valve which in response to a suction on one side of the valve allows input fluid at a low pressure to pass through the valve and into a receiving chamber, and in response to a high pressure in the receiving chamber enables fluid at a high pressure in the chamber to pass through the valve to an outlet port, while blocking the low pressure input to the valve.

The high pressure fluid pump can further have, in an illustrated embodiment, a double seal arrangement for preventing fluid leakage around the pistons.

DESCRIPTION OF THE DRAWINGS

Other features and advantages of the invention will be apparent from the following description taken together with the following drawings, in which like reference numbers represent like parts.

DESCRIPTION OF EMBODIMENTS OF THE INVENTION

Figure 1:
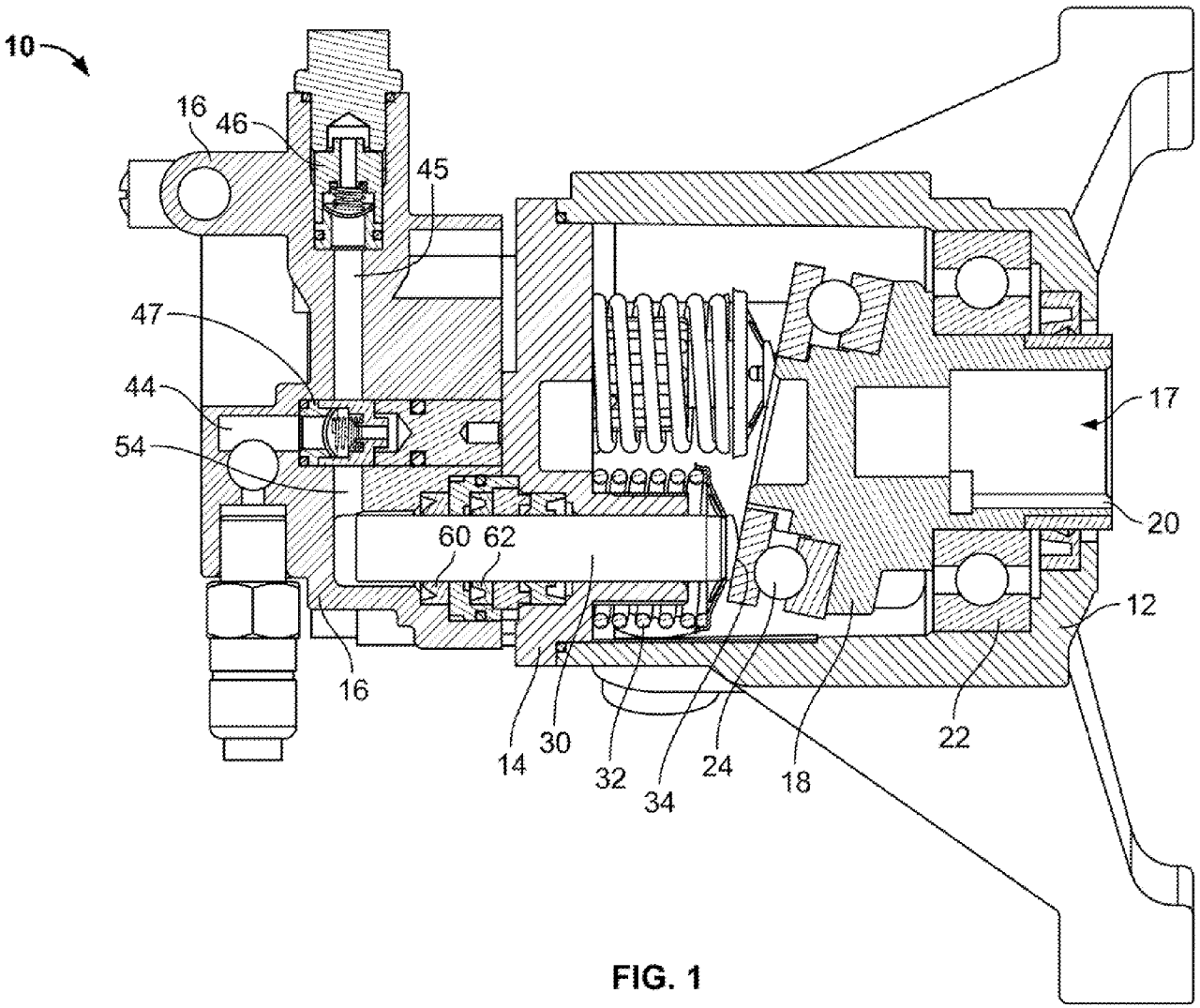
FIG. 1 is a cross-sectional drawing of a pump in accordance with one embodiment of the invention.

Referring to FIG. 1, there are 3 major components of the illustrated pump 10, a pump pedestal 12, a piston housing 14, and a pump head or manifold 16. The pump pedestal 12 connects the pump and a motor or engine (not shown). The pump is connected with the engine when the engine's rotary output shaft is inserted into a receiving recess 17 of the pump's wobble plate 18, having a long key 20 locking rotation of the engine shaft to the wobble plate. The rotational motion of the engine shaft thus rotates the wobble plate.

Figure 2:
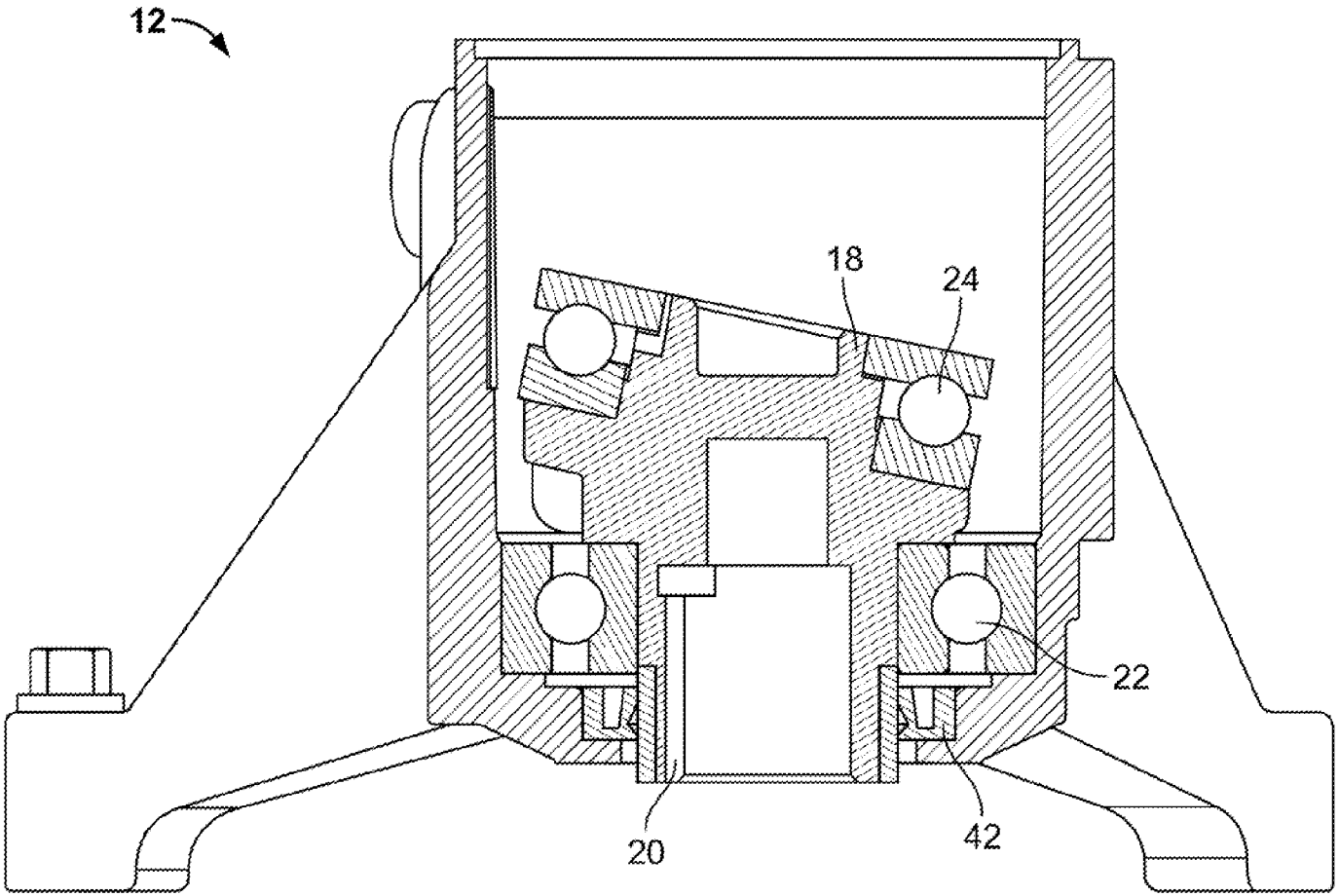
FIG. 2 is an enlarged cross-sectional view of the pump pedestal of the pump of FIG. 1.

Referring to FIG. 2, there is a deep groove ball bearing 22 to control the radial motion of the wobble plate and a thrust ball bearing 24 to control the axial thrust that moves the pump pistons 30. The movement of wobble plate causes the pump pistons (three in the illustrated embodiment) to move reciprocatingly. Inside the pump pedestal, lubricating oil is used to reduce the friction from the pistons' movement.

The piston housing 14 contains the three pistons 30, with their respective return springs 32 and spring seats 34. The pistons are pressed tightly by the return springs against the plate of the wobble plate thrust bearing, and each rotation of the wobble plate will cause the each piston to move up and down one time whereby water at a high pressure is thus formed in a high pressure chamber. There are plural concave indents 40 on the piston housing to contain respective oil seals 42 that prevent the oil from the pump pedestal from leaking out along with the motion of the pistons in and out of the pump pedestal.

The pump head, when it has three pistons, has three cylindrical chambers at 120 degrees to each other to accommodate the travel of the three pistons in this illustrative embodiment.

Figure 5:
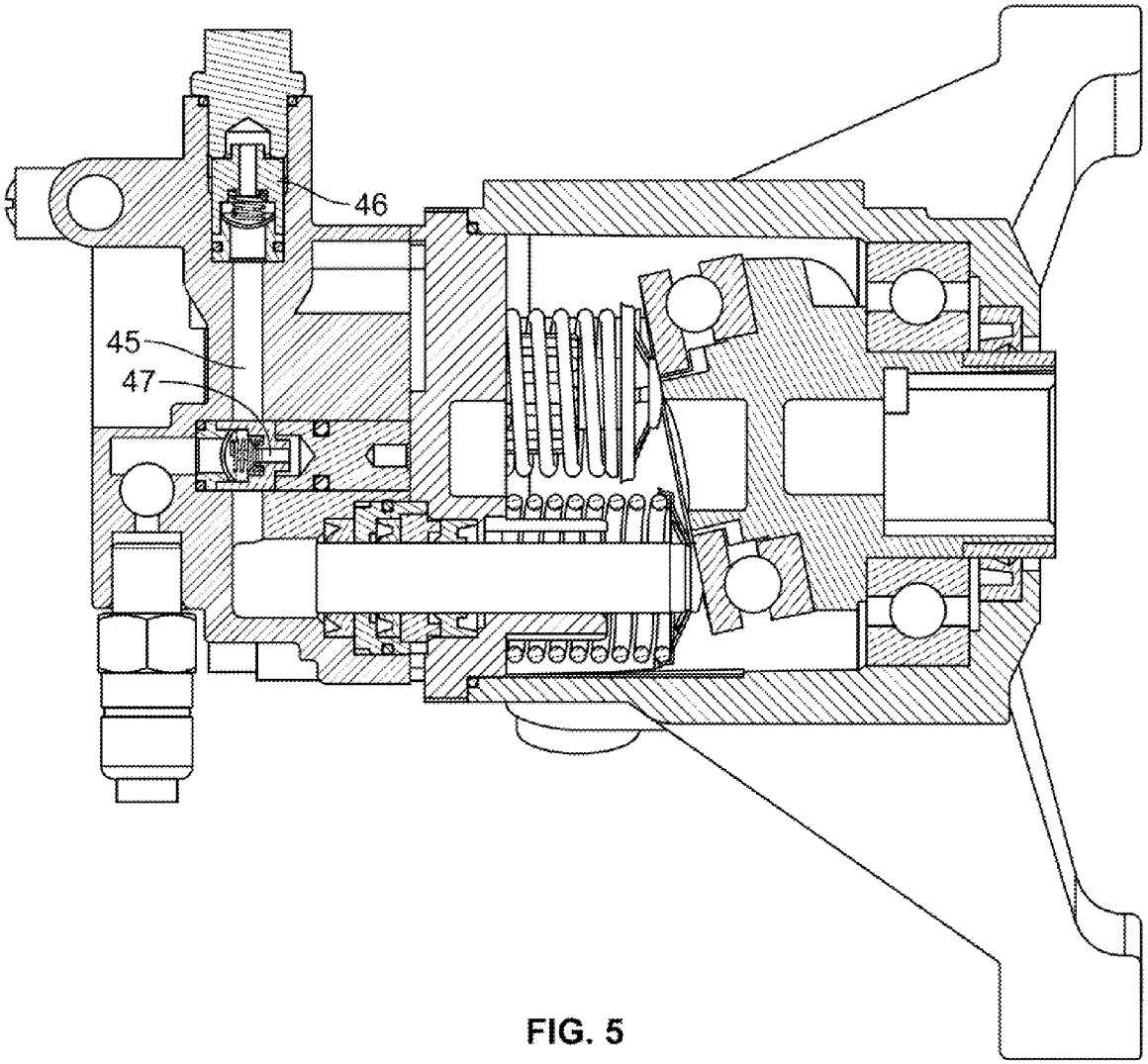
FIG. 5 is a cross-sectional view showing the beginning of a piston fluid compression stroke for one piston of the pump of FIG. 1.
Figure 6:
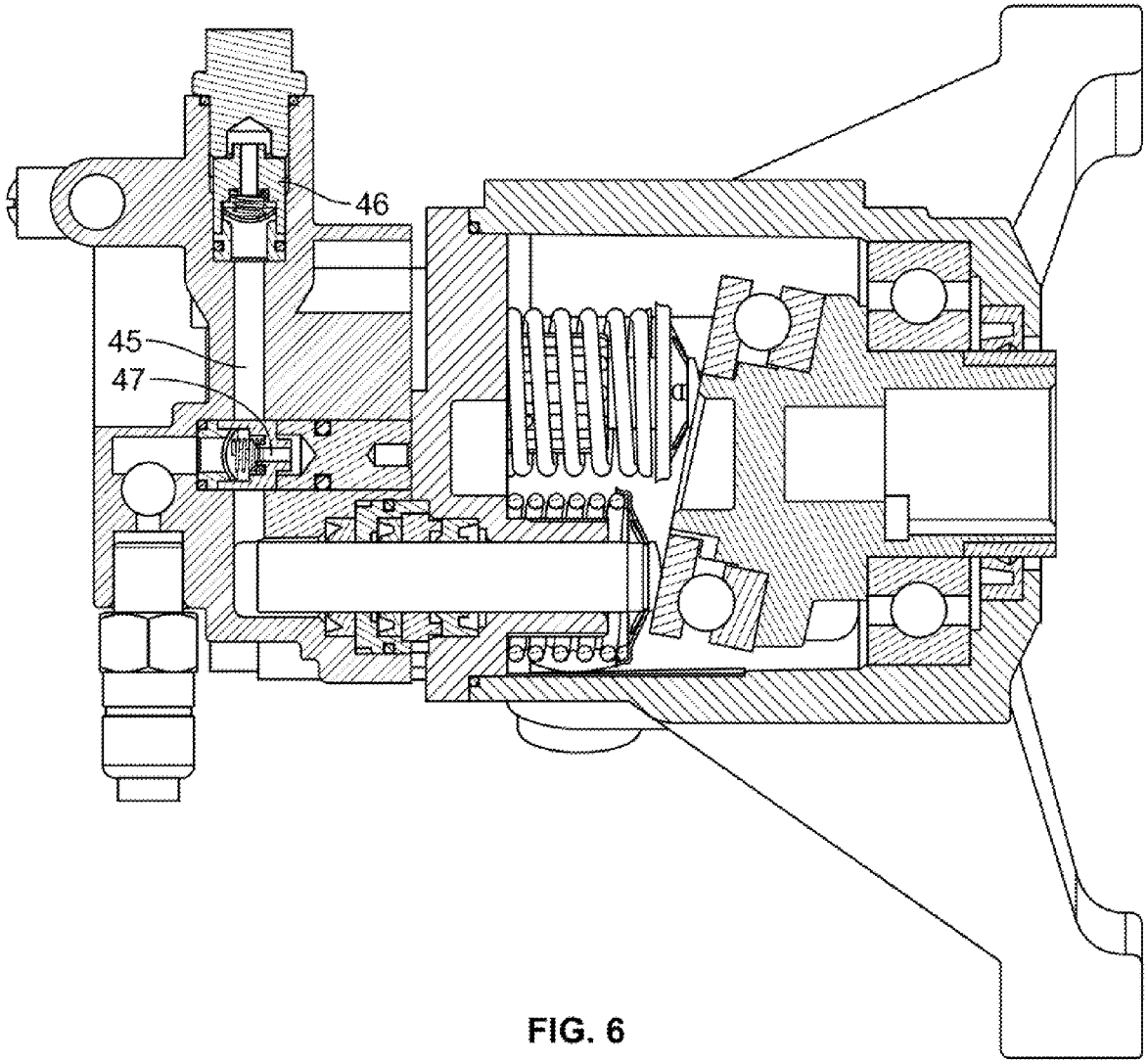
FIG. 6 is a cross-sectional view showing the end of a piston fluid compression stroke for the piston of FIG. 5 in accordance with the pump of FIG. 1.

When water at low pressure enters from the inlet pipe 43 to a chamber 44 to a one way valve 47, it flows to a chamber 45 (heavily cross-hatched portion of FIG. 5) to which the three cylindrical piston chambers connect, and where the pistons are pushed reciprocatingly by the wobble plate 18 to compress the water (darkened section of FIG. 6) in chamber 45. The outlet is controlled by a one-way valve 46. From the chamber 45, the pressurized water flows into the high pressure hose (not shown) and out of the nozzle. (See also FIG. 6). The reason the pump can produce a high pressure water jet is because the pressurized water cannot freely flow out of the tubing due to the relatively small diameter of the nozzle exit orifice.

Figure 3:
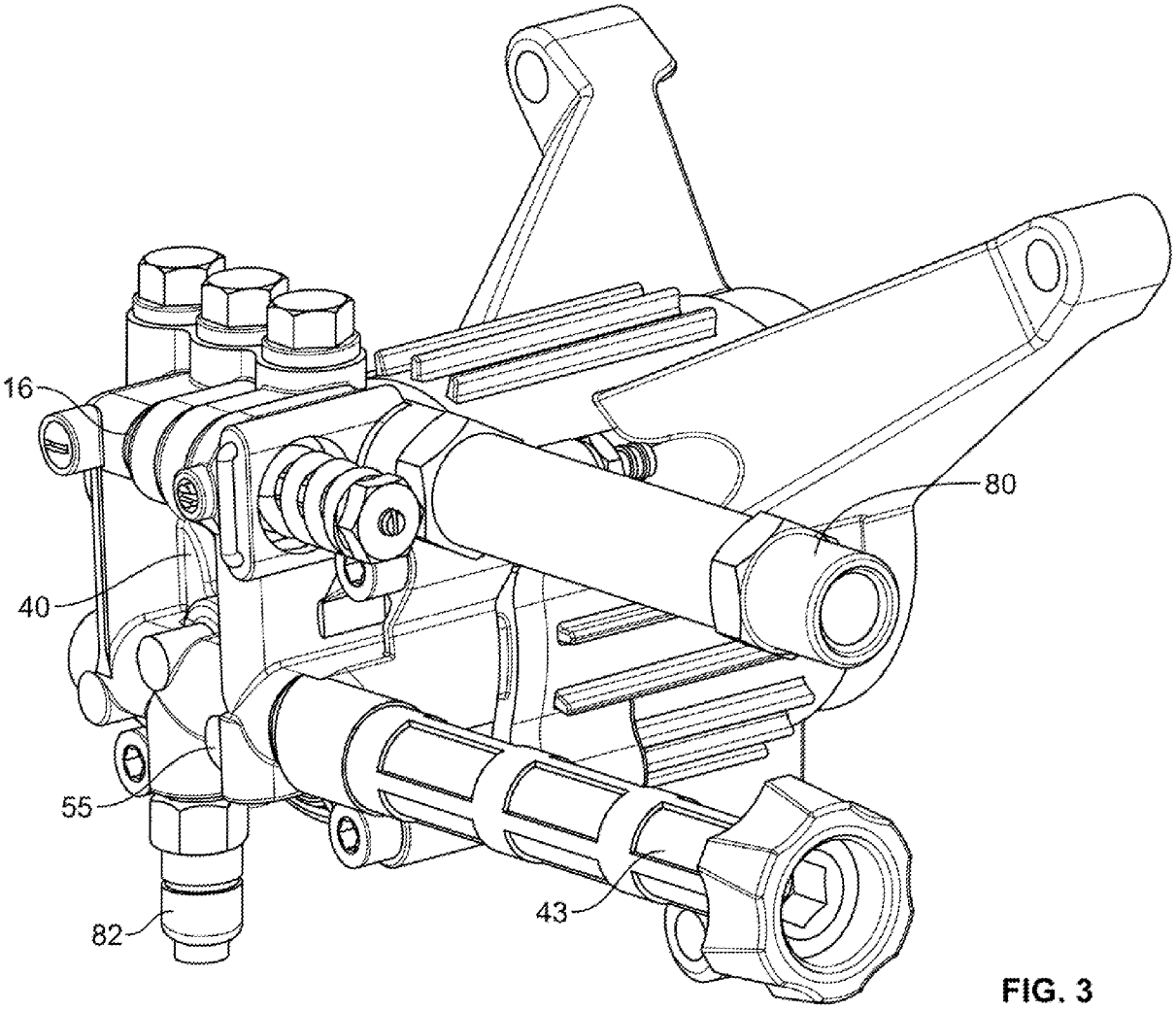
FIG. 3 is a perspective drawing of the outside mechanical structure of the pump of FIG. 1.
Figure 4:
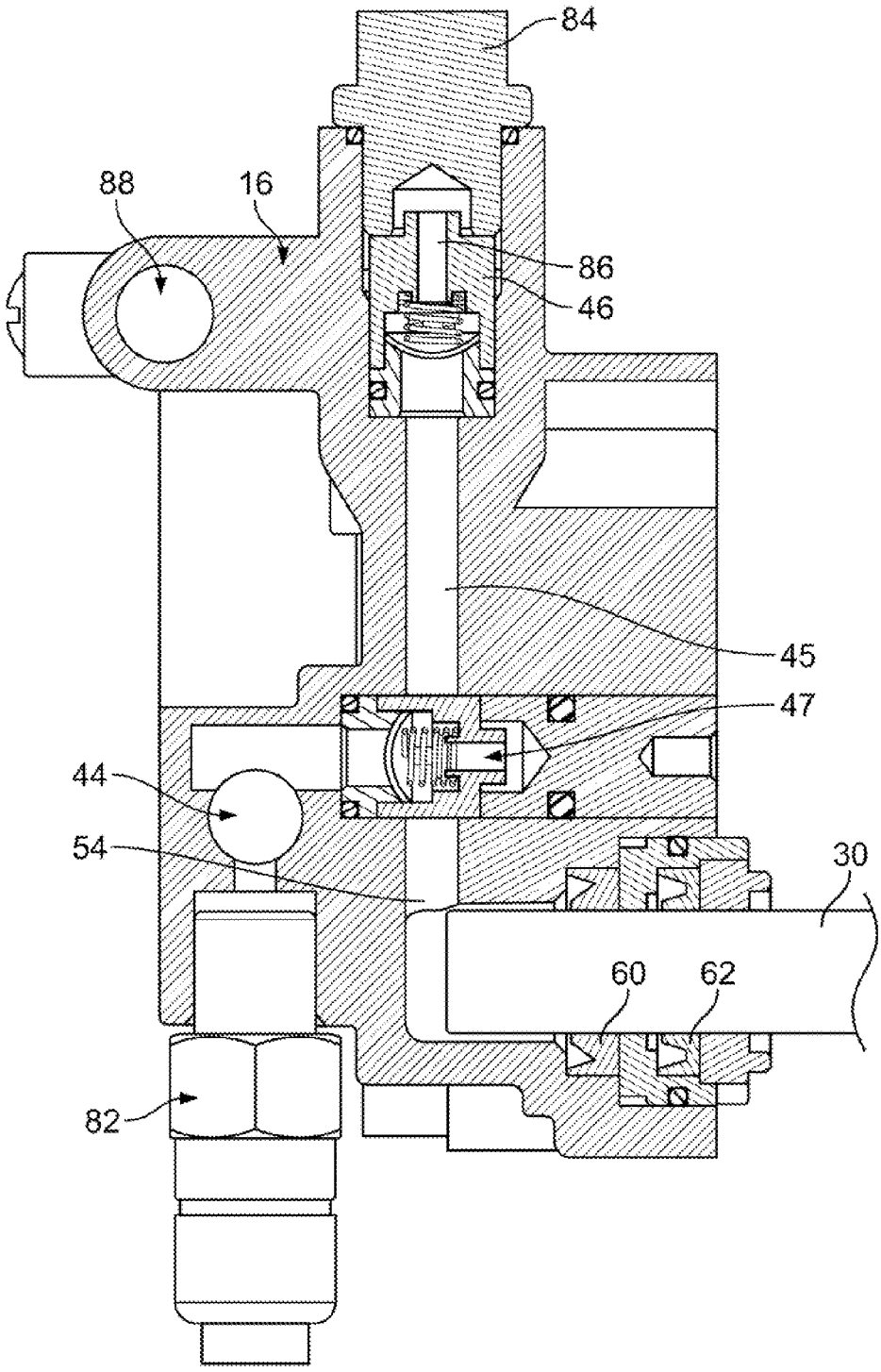
FIG. 4 is an enlarged cross-sectional view showing the fluid flow portion of the pump of FIG. 1.

The pump head 16, in the illustrated embodiment, is made of aluminum alloy instead of, for example, a stronger (and heavier) material such as brass. Usually the tensile performance of aluminum is far less than that of brass, so that the pump head, working with high pressure water at about 2000 psi or more, is often made with brass. To enable the aluminum pump head to work with high pressure water without premature wear, it is designed with a streamlined water flow passage channel 54. Based on this construction, relieved surfaces 55 (FIG. 3) are used to increase the strength of the pump head and prevent its deformation under impact. Also a larger cross-sectional area channel 45 is used to avoid bottlenecks inside the high pressure water channel and thereby to reduce the tensile pressure in the pump's high pressure area.

The pump of the illustrated embodiment also uses a double water sealing construction 60, 62 greatly improving the sealing capability of the structure.

The pump also uses a "go-thru" one-way check valve 47 (the inlet valve) to simplify the passage of water through the pump as described below.

The pump of the invention has the following characteristics.

Efficiency of the described pump is generally higher than typical pumps of the same class. To increase the efficiency, the area of the flow passage channel 45 is increased from the usual Φ3.5 mm to Φ5-6.5 mm to reduce friction resistance to the water flow. As a result, the loss of pressure is less, and the pump can produce higher pressure than currently available in typical wobble plate pumps of a similar class.

To save material and reduce cost, the "go-thru" one-way valve construction 47 is used at the input, so that when the wobble plate 18 causes a piston to retreat (toward the wobble plate) (FIG. 5), a vacuum is formed in the chamber 45, and the inlet one-way valve 47 opens to allow low pressure water to flow into the pump chamber 45 from chamber 44.

When the piston advances away from the wobble plate, (FIG. 6), the inlet one-way valve 47 is closes, the chamber 45 inside the pump head becomes pressurized, and high pressure water enters the outlet one-way valve 46 to outlet tube 80. In this process, the water from the piston chambers passes through the inlet "go-thru" one-way valve 47. In this stage of operation, the inlet one-way valve 47 thus becomes a "pass-thru" one-way valve. The water passage path construction is simplified by this structure. Due to the use of "go-thru" one-way valve 47 described above, the construction of the pump head becomes ever more compact.

As noted above, the pump head uses aluminum to further reduce cost. However, to strengthen the pressure-enduring property of the aluminum pump head, and thus prevent its deformation under pressure, a "relieved surface" design (mentioned above) as illustrated at 55, is used to reinforce the pump head. This design, while maintaining a smooth water flow passage, enhances the pump head's strength. Finally, (also, as mentioned above), to further avoid a bottleneck in the flow of water, a larger size (ϕ 5-6.5 mm) water passage channel is used. The pump also uses a dual water seal 60, 62 (primary and secondary) construction to effectively prevent water leakage.

The pump, in accordance with the illustrated embodiment of the invention, further has safety features for proper operation and care. The pump has, for example, a thermal safety relief valve 82 to relieve high temperature water in the pump chamber and hence prevent damage due to such high temperatures. In addition, each piston has associated with its structure an end cap 84 communicating, with the chamber 45 through a channel 86 in the output valve 46. Lastly, although somewhat difficult to see due to the complex nature of the pump device, the channel 88 communicates with the output valve 46 through a hidden channel, not shown, and connects to the output tube 86.

Other objects and features of the invention will be apparent to one practiced in this field, and are within the scope of the following claims.

What is claimed is:

1. A high pressure fluid pump comprising:

a piston housing;

a pump head connected to and supported by the piston housing; and a pump pedestal for supporting the aforementioned pump head and the piston housing;

the pump head receiving fluid at a low pressure, and, in combination with the piston housing, producing fluid through a first chamber at a high pressure;

the combination of the piston housing and the pump head containing a first one-way check valve, at least one piston, and a second chamber that accommodates movement of the piston, wherein the first one-way check valve in response to a suction on one side of the first one-way check valve, allows the received fluid at the low pressure to pass through an inlet of the first one-way check valve along an axis of the first one-way check valve and into a first chamber and to pass through the first chamber along a longitudinal axis of the first chamber, and, in response to the high pressure in the second chamber enables fluid at the high pressure in the first chamber to pass through the first one-way check valve to an outlet port while blocking the inlet of the first one-way check valve, wherein, during a stroke toward the first chamber, the piston compresses the fluid in the first chamber to produce fluid at the high pressure, causes the fluid at the high pressure to pass through the first chamber and the first one-way check valve along the longitudinal axis of the first chamber and into a third chamber, and causes the fluid at the high pressure to pass through the third chamber along a longitudinal axis of the third chamber and into the outlet port along an axis of a second one-way check valve;

wherein the longitudinal axis of the first chamber is perpendicular to the axis of the first one-way check valve;

wherein the longitudinal axis of the third chamber is perpendicular to the axis of the first one-way check valve; and wherein the axis of the second one-way check valve is perpendicular to the axis of the first one-way check valve.

2. The high pressure fluid pump of claim 1 further comprising, said pump head comprising aluminum, and wherein the outer surfaces of the pump have concave relief elements for strengthening the pump head against high pressures from within the pump head.

3. The high pressure fluid pump of claim 1, wherein the first chamber has a diameter greater than 5 mm.

4. A high pressure fluid pump comprising:

a piston housing;

a pump head connected to and supported by the piston housing; and a pump pedestal for supporting the aforementioned pump head and the piston housing;

the pump head receiving fluid at a low pressure, and, in combination with the piston housing, producing fluid through a first chamber at a high pressure;

the combination of the pump head, the piston housing, and the pump pedestal tighter enclosing and including a wobble plate, a plurality of pistons, and a second chamber that accommodates movement of at least one of the plurality of pistons, wherein the wobble plate is rotated by an external rotary source, the wobble plate being in contact with and driving the pistons to reciprocate the pistons in timed sequence to each other, and the pistons causing fluid at the low pressure to be drawn into the first chamber on a first stroke away from the first chamber and compressing the fluid in the flow channel during a second stroke toward the first chamber to produce fluid at the high pressure, and the combination of the piston housing and the pump head containing a first one-way check valve which in response to a suction on one side of the first one-way check valve, allows the received fluid at the low pressure to pass through an inlet of the first one-way check valve along an axis of the first one-way check valve and into the first chamber and to pass through the first chamber along the longitudinal axis of the first chamber, and, in response to the high pressure in the chamber, enables fluid at the high pressure in the first chamber to pass through the first one-way check valve to an outlet port while blocking the inlet of the first one-way check valve, wherein, during the second stroke, at least one of the plurality of pistons causes the fluid at the high pressure to pass through the first chamber and the first one-way check valve along the longitudinal axis of the first chamber and into a third chamber, and causes the fluid at the high pressure to pass through the third chamber along a longitudinal axis of the third chamber and into the outlet port along an axis of a second one-way check valve;

wherein the longitudinal axis of the first chamber is perpendicular to the axis of the first one-way check valve;

wherein the longitudinal axis of the third chamber is perpendicular to the axis of the first one-way check valve; and wherein the axis of the second one-way check valve is perpendicular to the axis of the first one-way check valve.

5. The high pressure fluid pump of claim 4 further comprising a double seal arrangement for preventing fluid leakage around the pistons.

* * * * *